US011986014B2

(12) United States Patent
Liu

(10) Patent No.: US 11,986,014 B2
(45) Date of Patent: May 21, 2024

(54) ATOMIZER

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 417 days.

(21) Appl. No.: 17/516,642

(22) Filed: Nov. 1, 2021

(65) Prior Publication Data

US 2022/0192265 A1 Jun. 23, 2022

(30) Foreign Application Priority Data

Dec. 21, 2020 (CN) ..... 202023122166.0

(51) Int. Cl.

| | |
|---|---|
| ***A24F 40/42*** | (2020.01) |
| ***A24F 40/10*** | (2020.01) |
| ***A24F 40/40*** | (2020.01) |
| ***A24F 40/46*** | (2020.01) |
| ***A24F 40/48*** | (2020.01) |

(52) U.S. Cl.

CPC ..... *A24F 40/42* (2020.01); *A24F 40/10* (2020.01); *A24F 40/40* (2020.01); *A24F 40/46* (2020.01); *A24F 40/48* (2020.01)

(58) Field of Classification Search

None

See application file for complete search history.

(56) References Cited

U.S. PATENT DOCUMENTS

| | | | | |
|---|---|---|---|---|
| 2018/0221605 | A1* | 8/2018 | Marks | A24F 40/46 |
| 2022/0061384 | A1* | 3/2022 | Liu | A24F 40/42 |
| 2022/0192265 | A1* | 6/2022 | Liu | H05B 3/42 |

FOREIGN PATENT DOCUMENTS

| | | | | |
|---|---|---|---|---|
| CA | 3123444 A1 * | 6/2022 | ..... | A24F 40/10 |

* cited by examiner

*Primary Examiner* — James Harvey

(74) *Attorney, Agent, or Firm* — MATTHIAS SCHOLL P.C.; Matthias Scholl

(57) ABSTRACT

An atomizer includes a first glass tube, a second glass tube, a heating element, and a base. The first glass tube includes a first hollow column and the second glass tube is partially disposed in the first hollow column and is integrated with the first glass tube. The heating element is in the shape of a disc. The heating element includes a central hole. The base includes a top portion and the heating element is disposed on the top portion. The first glass tube further includes a first opening configured to receive the base. The heating element is disposed in the first opening. The second glass tube is disposed above the central hole; a space between the first glass tube and the second glass tube is configured to store e-liquid; and the second glass tube further includes a second hollow column functioning as a smoke or vapor passage.

10 Claims, 4 Drawing Sheets

ATOMIZER

CROSS-REFERENCE TO RELATED APPLICATIONS

Pursuant to 35 U.S.C. § 119 and the Paris Convention Treaty, this application claims foreign priority to Chinese Patent Application No. 202023122166.0 filed Dec. 21, 2020, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to an atomizer.

Conventional atomizers include a lot of parts for e-liquid storage, atomization, and emission. The complex structure leads to high production costs. In addition, the parts are made of metals. The e-liquid stored in the metal container tends to be corroded and produce harmful substances thus adversely affecting the quality of the smoke or vapor.

SUMMARY

The disclosure provides an atomizer comprising a first glass tube, a second glass tube, a heating element, and a base; the first glass tube comprises a first hollow column and the second glass tube is partially disposed in the first hollow column and is integrated with the first glass tube; the heating element is in the shape of a disc; the heating element comprises a central hole; the base comprises a top portion and the heating element is disposed on the top portion; the first glass tube further comprises a first opening configured to receive the base; the heating element is disposed in the first opening; the second glass tube is disposed above the central hole; a space between the first glass tube and the second glass tube is configured to store e-liquid; and the second glass tube further comprises a second hollow column functioning as a smoke or vapor passage.

In a class of this embodiment, the heating element further comprises a plurality of through holes as e-liquid passages.

In a class of this embodiment, the atomizer further comprises a sleeve disposed on the heating element and abuts against the top portion of the base to fasten the heating element on the base thereby preventing the heating element from detaching from the base.

In a class of this embodiment, the sleeve comprises a plurality of notches communicating with the plurality of through holes, respectively.

In a class of this embodiment, the atomizer further comprises a first silicone ring and a second silicone ring; the first silicone ring comprises a third hollow column disposed in the central hole of the heating element; the first silicone ring further comprises a first surface abutting against the second glass tube and the second hollow column communicates with the third hollow column; the second silicone ring is disposed between the heating element and the top portion of the base to protect the heating element.

In a class of this embodiment, the atomizer further comprises a sealing base and a seal ring; the sealing base is secured within the base and disposed under the heating element to prevent leakage of the e-liquid; the seal ring is disposed between an inner wall of the first glass tube and an outer wall of the base to prevent leakage of the e-liquid.

In a class of this embodiment, the outer wall of the base comprises an air inlet.

In a class of this embodiment, the e-liquid flows through the plurality of notches of the sleeve into the heating element and is atomized therein to produce smoke or vapor; the air flows into the base via the air inlet to drive the smoke or vapor to pass through the third hollow column, the second hollow column, and the first glass tube and is inhaled by a user.

The following advantages are associated with the atomizer of the disclosure:

1. The first glass tube is integrated with the second glass tube to form a space for storage of the e-liquid to be atomized; and the second glass tube comprises the second hollow column that allows air to flow through. Therefore, the atomizer offers advantages such as a simple structure, a reduced number of components, and low cost.

2. The heating element is in the shape of a disc and comprises the central hole. The plurality of heating wires is spirally disposed on the bottom surface of the heating element to absorb a large amount of the e-liquid, increase heating area, and produce a large amount of smoke.

3. The atomizer comprises an e-liquid guide structure, an e-liquid seal structure, an e-liquid storage structure, and a smoke exhaust structure, all of which comprise glass due to properties such as healthy and environmentally benign nature.

Figure 1:
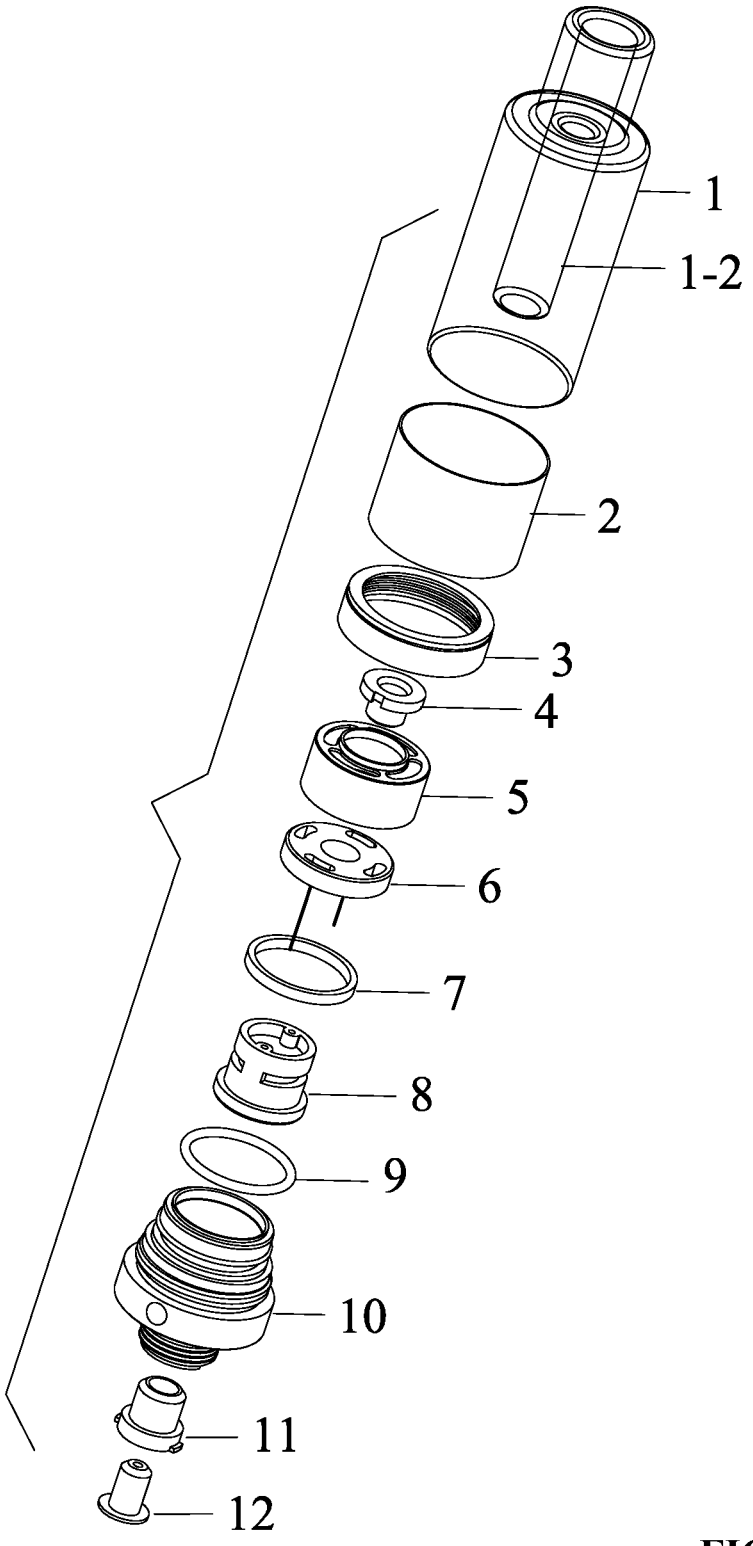
FIG. 1 is an exploded view of an atomizer according to one embodiment of the disclosure.

In the drawings, the following reference numbers are used: 1. First glass tube; 1-2. Second glass tube; 2. First seal; 3. Second seal; 4. First silicone ring; 5. Sleeve; 6. Heating element; 7. Second silicone ring; 8. Sealing base; 9. Seal ring; 10. Base; 11. Insulating ring; and 12. Electrode.

DETAILED DESCRIPTION

To further illustrate, embodiments detailing an atomizer are described below. It should be noted that the following embodiments are intended to describe and not to limit the disclosure.

Figure 2:
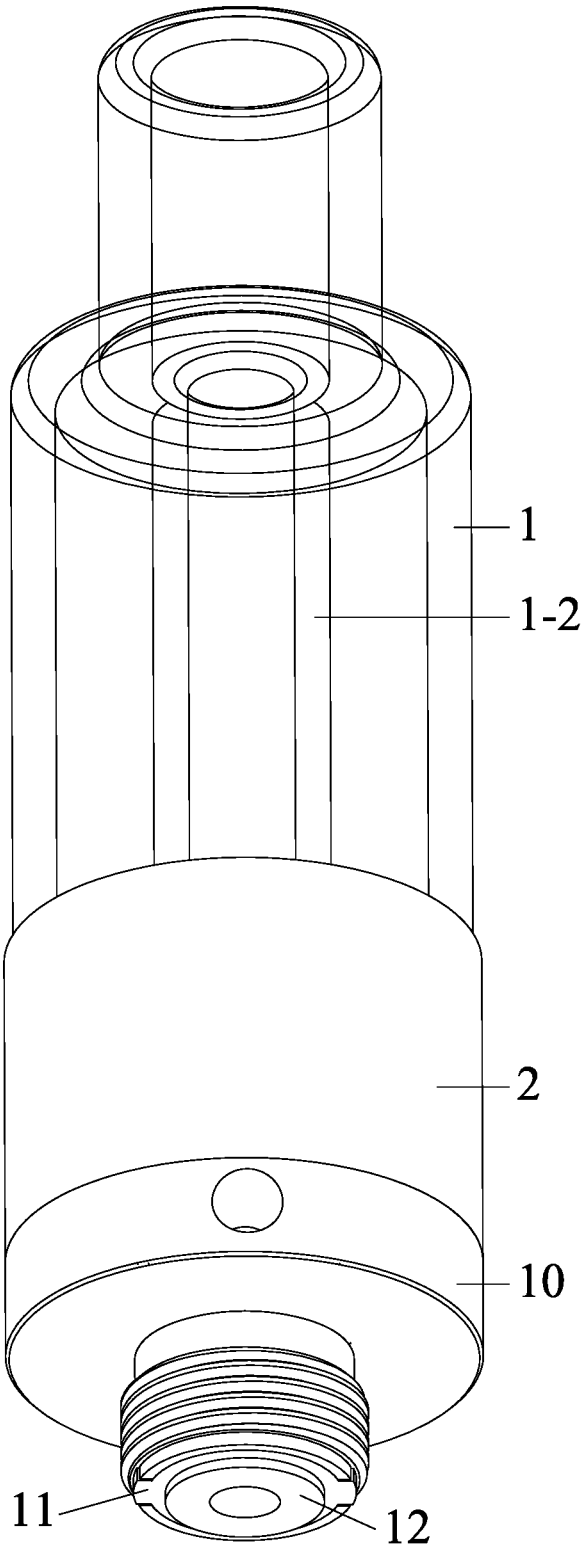
FIG. 2 is a perspective view of an atomizer according to one embodiment of the disclosure.
Figure 3:
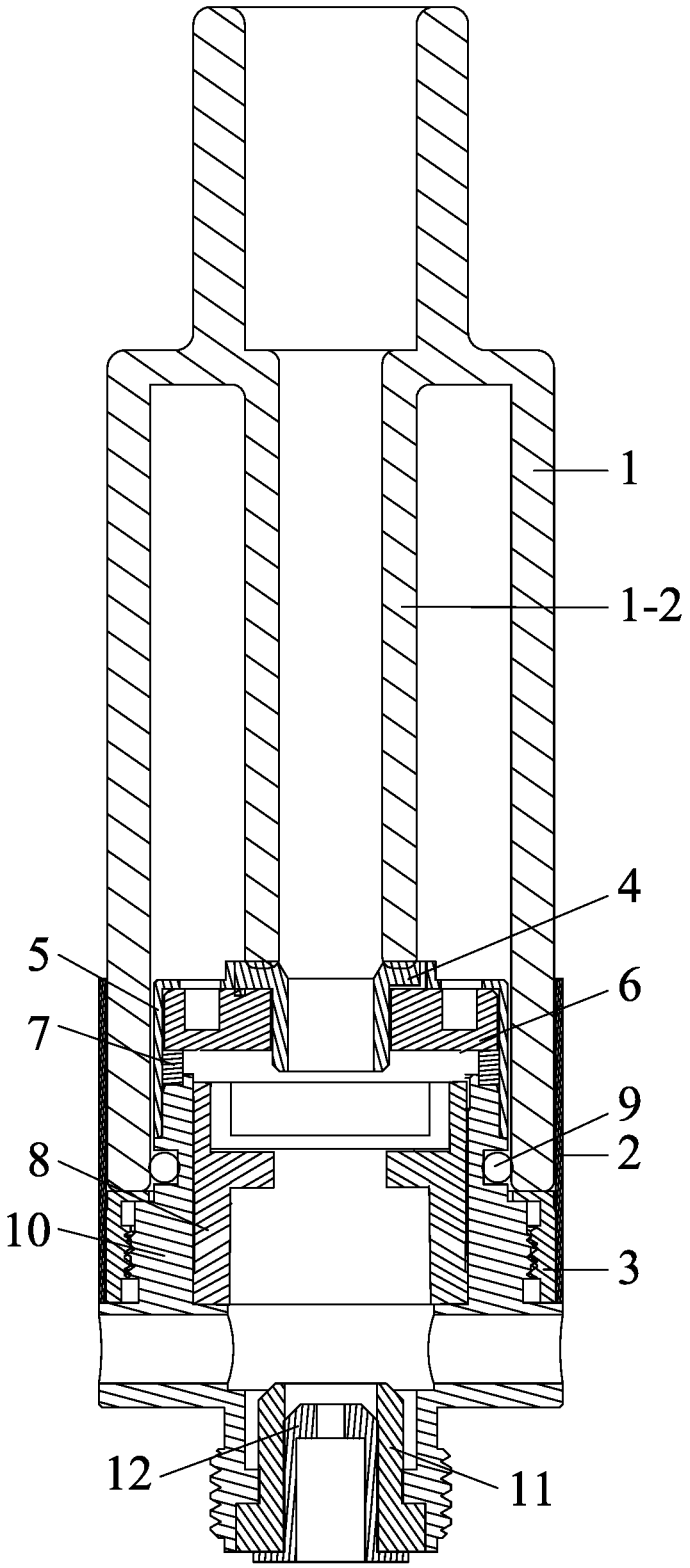
FIG. 3 is a cross-sectional view of an atomizer according to one embodiment of the disclosure.
Figure 4:
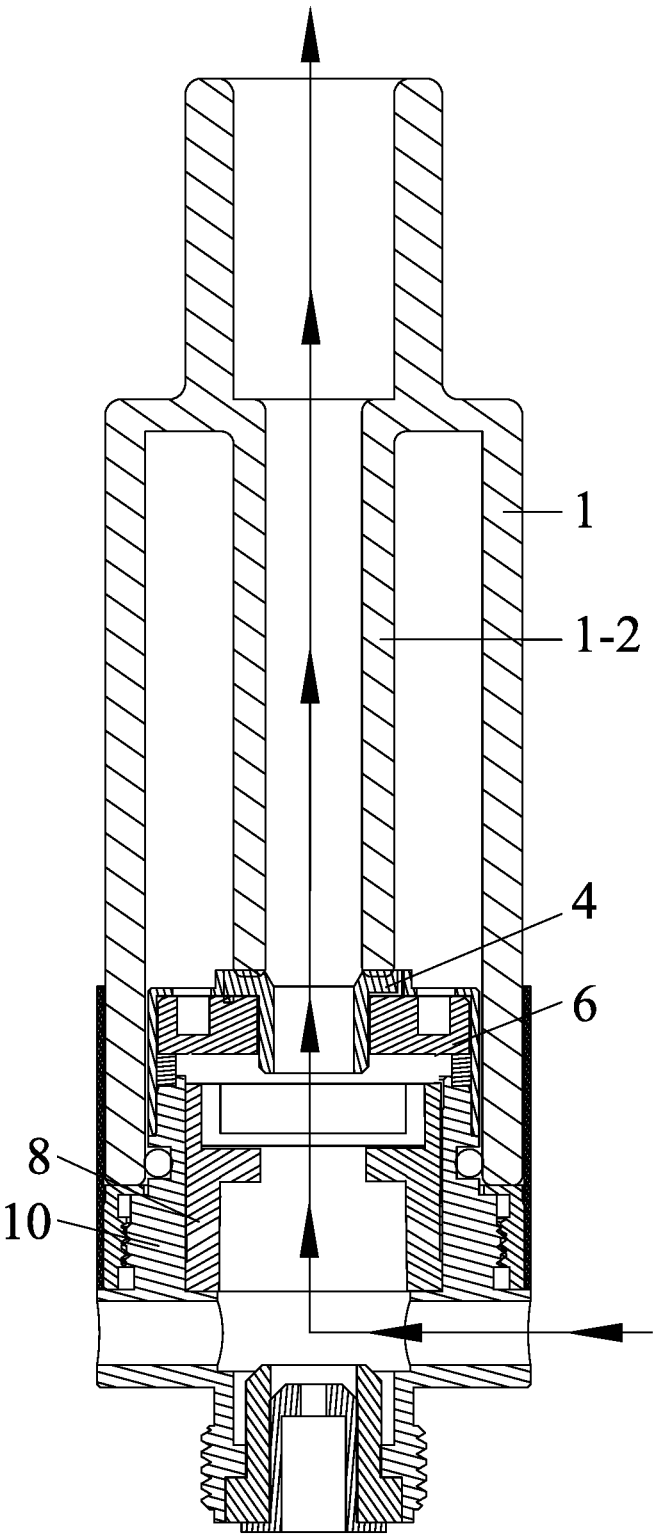
FIG. 4 is a cross-sectional view including arrows showing the direction of smoke and air in an atomizer according to one embodiment of the disclosure.

Referring to FIGS. 1-3, an atomizer comprises a first glass tube 1, a second glass tube 1-2, a first seal 2, a second seal 3, a first silicone ring 4, a sleeve 5, a heating element 6, a second silicone ring 7, a sealing base 8, a seal ring 9, a base 10, an insulating ring 11, and two electrodes 12. The first glass tube 1 comprises a first hollow column and the second glass tube 1-2 is partially disposed in the first hollow column. A space between the first glass tube 1 and the second glass tube 1-2 is configured to store e-liquid. The second glass tube 1-2 comprises a second hollow column functioning as a smoke or vapor passage. The heating element 6 is in the shape of a disc and comprises a central hole. The base 10 comprises a top portion and the heating element is disposed on the top portion. The second silicone ring 7 is disposed between the heating element 6 and the top portion of the base 10 to protect the heating element 6. The sealing base 8 is secured within the base 10 and disposed under the heating element 6 to prevent leakage of the e-liquid. The sleeve 5 is disposed on the heating element 6 and abuts against the top portion of the base 10 to fasten the heating element 6 on the base 10 thereby preventing the heating element 6 from detaching from the base. The first silicone ring 4 comprises a third hollow column disposed in the central hole of the heating element. The second seal 3 is disposed around a peripheral wall of the base 10 to support the first glass tube 1. The first glass tube 1 comprises a first opening configured to receive the base 10. The heating element 6 is disposed in the first opening. The first silicone ring 4 further comprises a first surface abutting against the second glass tube and the second hollow column communicates with the third hollow column. The seal ring 9 is disposed between an inner wall of the first glass tube and an outer wall of the base 10 to prevent leakage of the e-liquid. The first seal 2 is disposed between the first opening and the base 10, so that the first glass tube 1 is fastened on the base 10. The heating element 6 comprises a positive pin and a negative pin. The base 10 further comprises a bottom portion and the insulating ring 11 is disposed in the bottom portion to isolate the positive pin and the negative pin, thereby preventing short circuit. The electrodes 12 are disposed in the insulating ring 11, so that the positive pin and the negative pin are connected to the electrodes 12 for conducting electricity.

In certain embodiments, the base 10 comprises an air guide ring comprising an air inlet. The amount of airflow is adjusted by rotating the air guide ring. The central hole can be replaced with a plurality of through holes and a plurality of heating wires is disposed in each of the plurality of through holes. Each of the plurality of heating wires possesses an arbitrary resistance value, has a diameter of any value, and comprises a metal or a metal alloy. The heating element 6 can be any shape and is wrapped with a cotton.

It will be obvious to those skilled in the art that changes and modifications may be made, and therefore, the aim in the appended claims is to cover all such changes and modifications.

What is claimed is:

1. An atomizer, comprising a first glass tube;

a second glass tube;

a heating element; and a base;

wherein:

the first glass tube comprises a first hollow column and the second glass tube is partially disposed in the first hollow column and is integrated with the first glass tube;

the heating element is in the shape of a disc; the heating element comprises a central hole;

the base comprises a top portion and the heating element is disposed on the top portion;

the first glass tube further comprises a first opening configured to receive the base;

the heating element is disposed in the first opening;

the second glass tube is disposed above the central hole; a space between the first glass tube and the second glass tube is configured to store e-liquid; and the second glass tube further comprises a second hollow column functioning as a smoke or vapor passage.

2. The atomizer of claim 1, wherein the heating element further comprises a plurality of through holes as e-liquid passages.

3. The atomizer of claim 1, wherein the atomizer further comprises a sleeve disposed on the heating element and abuts against the top portion of the base to fasten the heating element on the base thereby preventing the heating element from detaching from the base.

4. The atomizer of claim 2, wherein the atomizer further comprises a sleeve disposed on the heating element and abuts against the top portion of the base to fasten the heating element on the base thereby preventing the heating element from detaching from the base.

5. The atomizer of claim 2, wherein the sleeve comprises a plurality of notches communicating with the plurality of through holes, respectively.

6. The atomizer of claim 3, wherein the sleeve comprises a plurality of notches communicating with the plurality of through holes, respectively.

7. The atomizer of claim 1, wherein the atomizer further comprises a first silicone ring and a second silicone ring; the first silicone ring comprises a third hollow column disposed in the central hole of the heating element; the first silicone ring further comprises a first surface abutting against the second glass tube and the second hollow column communicates with the third hollow column; the second silicone ring is disposed between the heating element and the top portion of the base to protect the heating element.

8. The atomizer of claim 3, wherein the atomizer further comprises a first silicone ring and a second silicone ring; the first silicone ring comprises a third hollow column disposed in the central hole of the heating element; the first silicone ring further comprises a first surface abutting against the second glass tube and the second hollow column communicates with the third hollow column; the second silicone ring is disposed between the heating element and the top portion of the base to protect the heating element.

9. The atomizer of claim 1, wherein the atomizer further comprises a sealing base and a seal ring; the sealing base is secured within the base and disposed under the heating element to prevent leakage of the e-liquid; the seal ring is disposed between an inner wall of the first glass tube and an outer wall of the base to prevent leakage of the e-liquid.

10. The atomizer of claim 1, wherein the outer wall of the base comprises an air inlet.

* * * * *